US010463087B1

(12) United States Patent
Wosochlo

(10) Patent No.: US 10,463,087 B1
(45) Date of Patent: Nov. 5, 2019

(54) ANTI-TICK LEG BAND

(71) Applicant: James Wosochlo, Orwigsburg, PA (US)

(72) Inventor: James Wosochlo, Orwigsburg, PA (US)

( * ) Notice: Subject to any disclaimer, the term of this patent is extended or adjusted under 35 U.S.C. 154(b) by 210 days.

(21) Appl. No.: 15/718,706

(22) Filed: Sep. 28, 2017

(51) Int. Cl.
*A41D 13/00* (2006.01)

(52) U.S. Cl.
CPC ..... *A41D 13/001* (2013.01); *A41D 2300/32* (2013.01)

(58) Field of Classification Search
CPC ..... A41D 13/001; A41D 2300/32; A41D 13/0543; A41D 17/00; A41D 17/005
USPC ..... 2/22, 23, 242, 170, 917, DIG. 11
See application file for complete search history.

(56) References Cited

U.S. PATENT DOCUMENTS 1,780,407 A * 11/1930 Smith ..... A01M 1/2044 119/654
4,057,853 A * 11/1977 McLane ..... A41D 17/00 2/22
4,217,722 A * 8/1980 McMullen ..... A01M 1/14 43/114
4,273,130 A * 6/1981 Simpson ..... A61B 17/1322 128/DIG. 15
4,800,671 A * 1/1989 Olson ..... A01M 1/18 43/108
4,829,604 A * 5/1989 Allen ..... A41D 13/088 2/162
4,829,702 A * 5/1989 Silvandersson ..... A01M 1/14 43/114
4,881,671 A * 11/1989 Horton ..... A01M 1/20 224/222
5,005,215 A * 4/1991 McIlquham ..... A41D 13/001 119/654
5,155,950 A 10/1992 Burgeson
5,170,503 A * 12/1992 Hightower, Jr. ..... A41D 17/02 2/22
5,249,310 A * 10/1993 Forte ..... A41D 13/001 2/239
5,381,557 A 1/1995 Luria et al.
5,454,186 A * 10/1995 Gang ..... A01M 1/14 43/114
6,272,691 B1 * 8/2001 Henricksen ..... A41F 19/005 2/126
7,748,159 B1 * 7/2010 Wenner ..... A01M 1/24 43/114
7,937,852 B1 * 5/2011 Krehbiel ..... A41D 17/005 2/22
2002/0124293 A1 * 9/2002 Zeiler ..... A01K 55/00 2/4
2005/0235397 A1 * 10/2005 Cosenza ..... A01M 1/14 2/242

(Continued)

*Primary Examiner* — Alissa L Hoey

(57) ABSTRACT

An anti-tick leg band having a folded band, a plastic backed layered adhesive having a plastic backing and a plurality of removable adhesive layers disposed on an inside of the folded band, and a plastic cover having a plurality of spacers disposed on the inside of the outer half of the folded band. The plurality of spacers is configured to separate the plastic cover and an outermost adhesive layer of the plurality of removable adhesive layers. A strap and buckle, as well as hook and loop fasteners, are used to secure the anti-tick leg band to a user's leg above the sock. When a tick or jigger begins to climb up a leg of a user, it will enter into the space between the plastic cover and the outermost adhesive layer, where it will then be stuck.

1 Claim, 4 Drawing Sheets

(56) References Cited

U.S. PATENT DOCUMENTS

| | | | | |
|---|---|---|---|---|
| 2007/0068066 | A1* | 3/2007 | Reatti | A01M 1/14 43/114 |
| 2012/0315317 | A1* | 12/2012 | O'Hara | A01N 25/08 424/414 |
| 2016/0021944 | A1* | 1/2016 | Miller | A41D 13/0543 2/22 |
| 2016/0037840 | A1* | 2/2016 | Basik | A41D 20/00 2/170 |
| 2017/0105460 | A1* | 4/2017 | Hartdorn | A41D 13/001 |
| 2017/0224137 | A1* | 8/2017 | Hartdorn | D06N 7/0092 |
| 2019/0066475 | A1* | 2/2019 | Bordelon | G08B 21/02 |

* cited by examiner

ANTI-TICK LEG BAND

BACKGROUND OF THE INVENTION

Ticks, and the diseases they carry, such as Lyme disease and Powassan disease, are rapidly reaching epidemic levels in many parts of the world. Various types of tick prevention devices are known in the prior art. However, most existing tick prevention devices are either cumbersome to wear or are chemically based. The prior art offered by Luria and Luria (U.S. Pat. No. 5,381,557) uses an adhesive trap design, yet the band presented in the prior art is not adjustable, and as it is elastic, will be prone to falling. Furthermore, the trap presented requires a user to properly cut and apply an adhesive tape, which creates a barrier to use. What is needed, and what the present anti-tick leg band provides, is a simple, non-chemical solution to tick prevention that is adjustable, secure, and easily reusable. The present anti-tick leg band has a folded band, a plastic backed layered adhesive having a plurality of removable adhesive layers disposed on an inside of the folded band, and a plastic cover having a plurality of spacers disposed on the inside of the outer half of the folded band. A strap and buckle, as well as hook and loop fasteners, are used to easily secure the anti-tick leg band to a user's leg. When a tick or jigger begins to climb up a leg of a user, it will enter into the space between the plastic cover and the outermost adhesive layer, where it will then be stuck. When the outermost adhesive layer is exhausted, the user may simply peel it off to expose a new layer.

FIELD OF THE INVENTION

The present invention relates to tick prevention devices, and more particularly, to an anti-tick leg band.

SUMMARY OF THE INVENTION

The general purpose of the present anti-tick leg band, described subsequently in greater detail, is to provide an anti-tick leg band that has many novel features that result in an anti-tick leg band which is not anticipated, rendered obvious, suggested, or even implied by prior art, either alone or in combination thereof.

To accomplish this, the present anti-tick leg band includes a folded band having an outer half, an inner half, a folded top, an open bottom, an outside, an inside, a strap end, and a buckle end. A plastic backed layered adhesive having a plastic backing and a plurality of removable adhesive layers is disposed on the inside of the inner half of the folded band. A plastic cover having a plurality of spacers is disposed on the inside of the outer half of the folded band. The plurality of spacers is configured to separate the plastic cover and an outermost adhesive layer of the plurality of removable adhesive layers. When a tick or jigger begins to climb up a leg of a user, it will enter the open bottom and into the space between the plastic cover and the outermost adhesive layer, where it will then be stuck.

A strap is disposed on the outside of the outer half of the folded band proximal the strap end. The strap is a hook and loop fastener. A buckle selectively engageable with the strap is disposed on the outside of the outer half of the folded band proximal the buckle end. A first hook and loop fastener section is disposed on the buckle end of the folded band, and a second hook and loop fastener section is disposed on the outside of the inner half of the folded band proximal the strap end thereof. The first hook and loop fastener section and the second hook and loop fastener section are selectively engageable.

An alternative optional embodiment of the present anti-tick leg band does not have the first hook and loop fastener section or the second hook and loop fastener section, but rather has a third hook and loop fastener section disposed along the entirety of the outside of the inner half of the folded band. The third hook and loop fastener section is selectively engageable with a fourth hook and loop fastener section integrated into a pair of pants.

Thus have been broadly outlined the more important features of the present anti-tick leg band so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
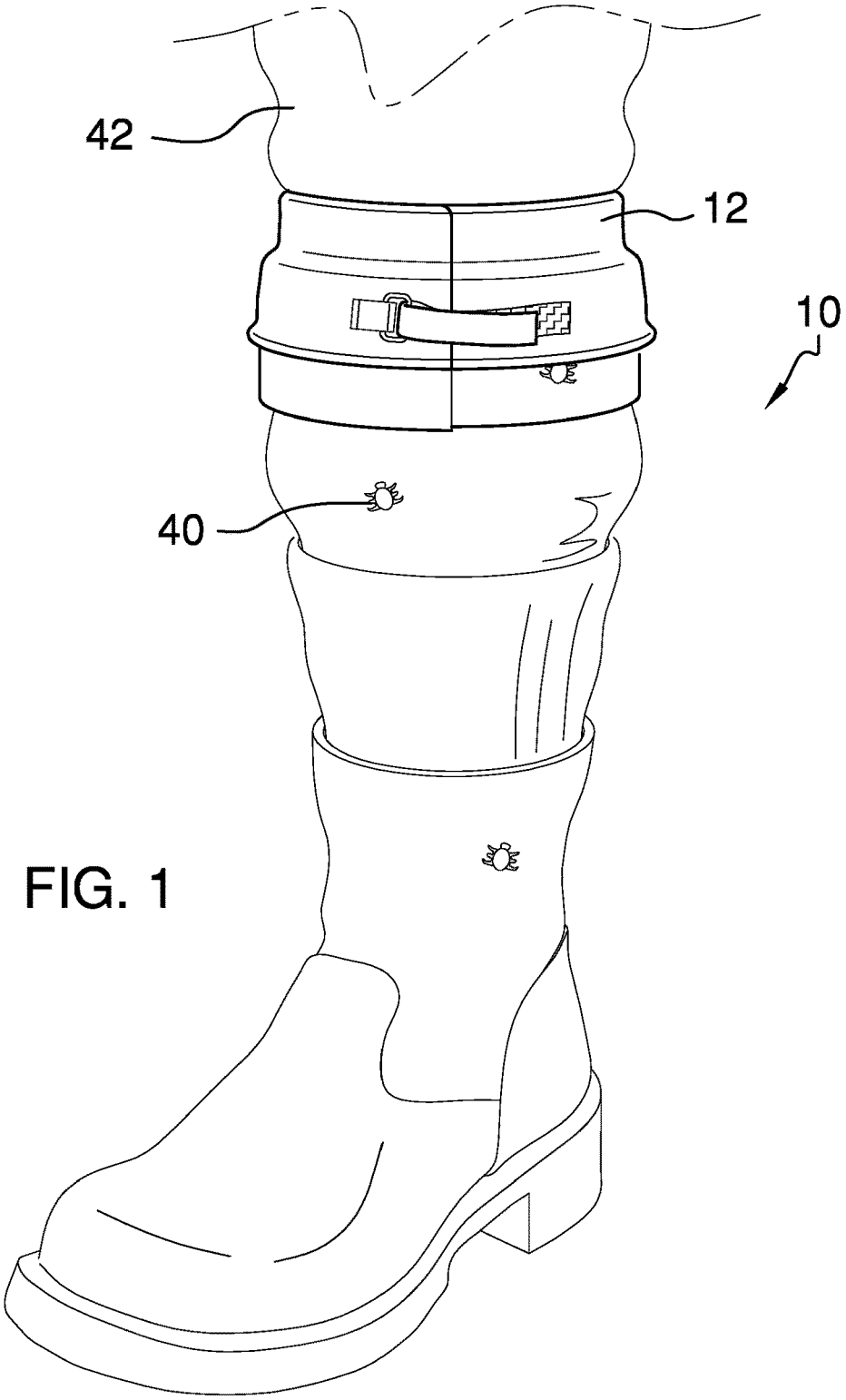
FIG. 1 is an isometric in-use view of an anti-tick leg band.
Figure 2:
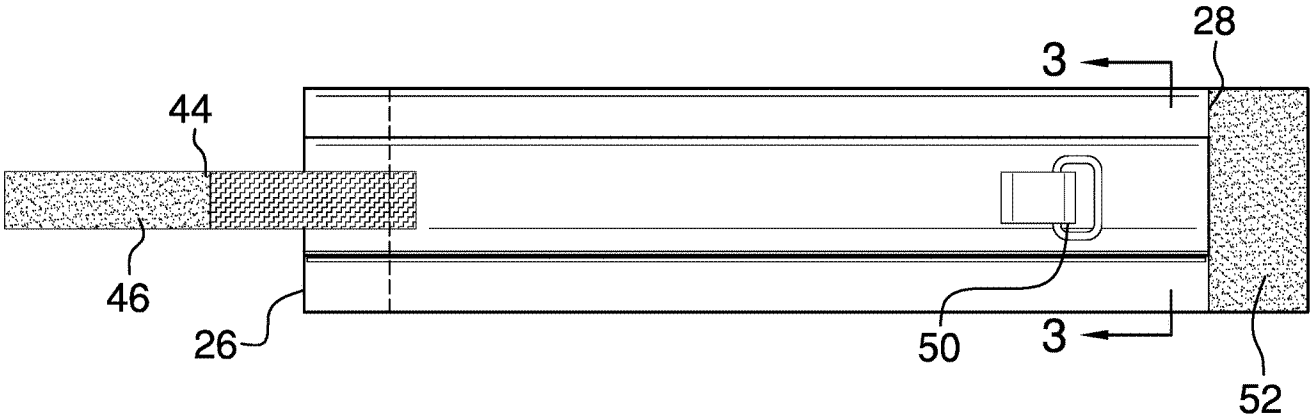
FIG. 2 is a front elevation view of the anti-tick leg band.
Figure 3:
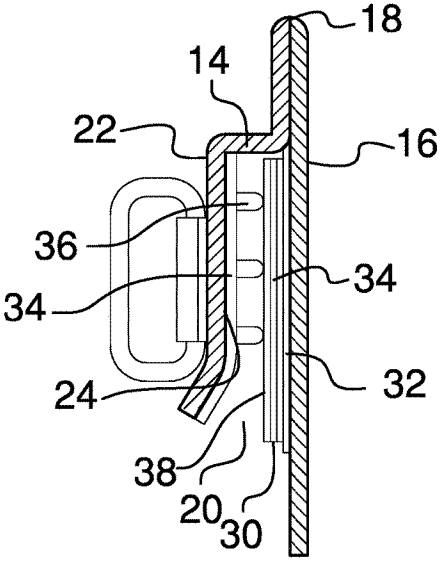
FIG. 3 is a cross-sectional view of the anti-tick leg band along line 3-3 of FIG. 2.
Figure 4:
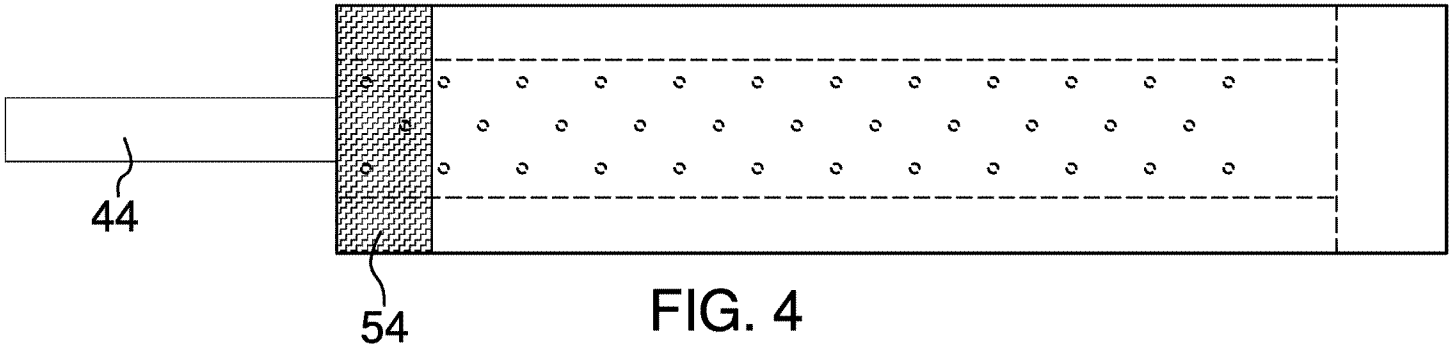
FIG. 4 is a rear elevation view of the anti-tick leg band showing a plurality of spacers in phantom.
Figure 5:
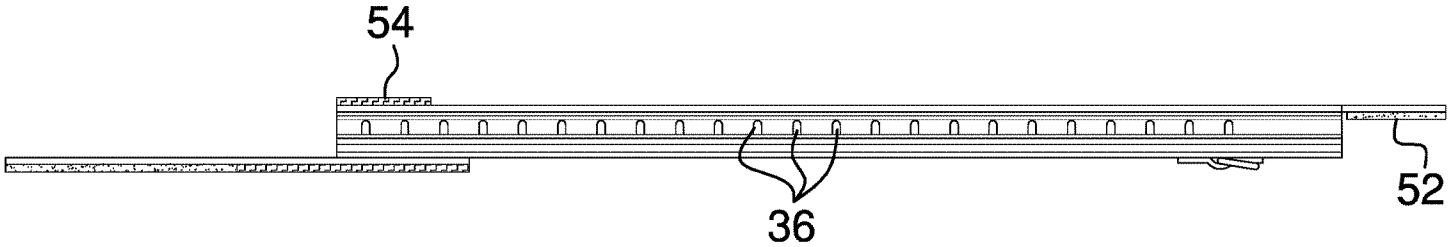
FIG. 5 is a bottom plan view of the anti-tick leg band.
Figure 6:
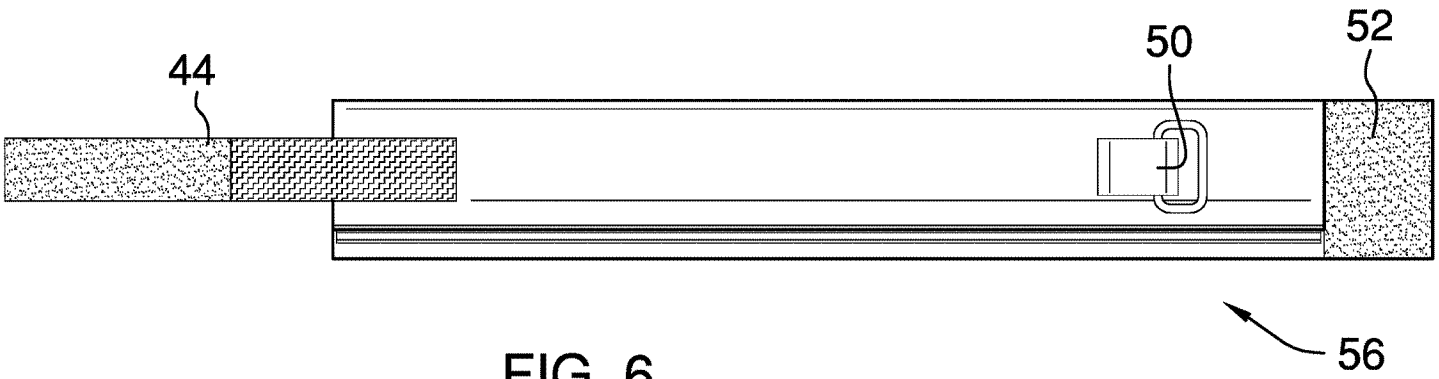
FIG. 6 is a front elevation view of an alternative embodiment of the anti-tick leg band.
Figure 7:
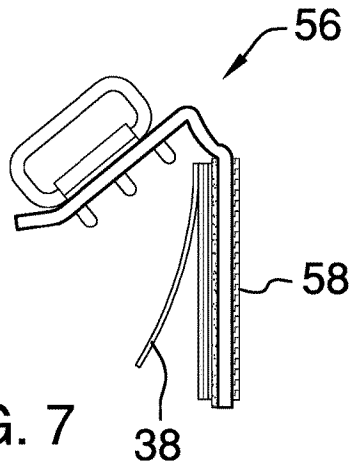
FIG. 7 is a right elevation view of the alternative embodiment of the anti-tick leg band.

With reference now to the drawings, and in particular FIGS. 1 through 7 thereof, an example of the instant anti-tick leg band employing the principles and concepts of the present anti-tick leg band and generally designated by the reference number 10 will be described.

Referring to FIGS. 1 through 7 the present anti-tick leg band 10 is illustrated. The anti-tick leg band 10 includes a folded band 12 having an outer half 14, an inner half 16, a folded top 18, an open bottom 20, an outside 22, an inside 24, a strap end 26, and a buckle end 28. A plastic backed layered adhesive 30 having a plastic backing 32 and a plurality of removable adhesive layers 40 is disposed on the inside of the inner half of the folded band. A plastic cover 34 having a plurality of spacers 36 is disposed on the inside of the outer half of the folded band. The plurality of spacers is configured to separate the plastic cover and an outermost adhesive layer 38 of the plurality of removable adhesive layers. When a tick or jigger 40 begins to climb up a leg of a user 42, it will enter the open bottom and into the space between the plastic cover and the outermost adhesive layer, where it will then be stuck.

A strap 44 is disposed on the outside of the outer half of the folded band proximal the strap end. The strap is a hook and loop fastener 46. A buckle 50 selectively engageable with the strap is disposed on the outside of the outer half of the folded band proximal the buckle end. A first hook and loop fastener section 50 is disposed on the buckle end of the folded band, and a second hook and loop fastener section 54 is disposed on the outside of the inner half of the folded band proximal the strap end thereof. The first hook and loop fastener section and the second hook and loop fastener section are selectively engageable.

An alternative optional embodiment of the present anti-tick leg band 56 does not have the first hook and loop fastener section or the second hook and loop fastener section, but rather has a third hook and loop fastener section 58 disposed along the entirety of the outside of the inner half of the folded band. The third hook and loop fastener section is selectively engageable with a fourth hook and loop fastener section integrated into a pair of pants.

What is claimed is:

1. An anti-tick leg band comprising:

a folded band having an outer half, an inner half, a folded top, an open bottom, an outside, an inside, a strap end, and a buckle end;

a plastic backed layered adhesive having a plastic backing and a plurality of removable adhesive layers, wherein the plastic backing is disposed on the inside of the inner half of the folded band; and a plastic cover having a plurality of spacers, wherein the plastic cover is disposed on the inside of the outer half of the folded band, wherein the plurality of spacers is configured to separate the plastic cover and an outermost adhesive layer of the plurality of removable adhesive layers;

a strap disposed on the outside of the outer half of the folded band proximal the strap end, wherein the strap is a hook and loop fastener;

a buckle disposed on the outside of the outer half of the folded band proximal the buckle end, wherein the buckle is selectively engageable with the strap;

a first hook and loop fastener section disposed on the buckle end of the folded band; and a second hook and loop fastener section disposed on the outside of the inner half of the folded band proximal the strap end thereof, wherein the first hook and loop fastener section and the second hook and loop fastener section are selectively engageable.

* * * * *